US007547015B2

(12) United States Patent
Lee et al.

(10) Patent No.: US 7,547,015 B2
(45) Date of Patent: Jun. 16, 2009

(54) IMAGE FORMING APPARATUS HAVING STOPPER

(75) Inventors: Bong-hee Lee, Suwon-si (KR); Ho-min Lim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 389 days.

(21) Appl. No.: 11/296,394

(22) Filed: Dec. 8, 2005

(65) Prior Publication Data

US 2006/0220303 A1 Oct. 5, 2006

(30) Foreign Application Priority Data

Mar. 31, 2005 (KR) ..... 10-2005-0026859

(51) Int. Cl.
*B65H 31/04* (2006.01)

(52) U.S. Cl. ..... 271/213; 271/224; 271/207

(58) Field of Classification Search ..... 271/207, 271/223, 224, 213
See application file for complete search history.

(56) References Cited

U.S. PATENT DOCUMENTS

| | | | | |
|---|---|---|---|---|
| 4,529,190 | A * | 7/1985 | Goodwin et al. | 271/213 |
| 5,241,353 | A * | 8/1993 | Maeshima et al. | 399/405 |
| 5,248,139 | A * | 9/1993 | Garland et al. | 271/184 |
| 5,280,897 | A * | 1/1994 | Maekawa | 271/3.03 |
| 5,305,994 | A * | 4/1994 | Matsui et al. | 270/58.13 |
| 5,308,058 | A * | 5/1994 | Mandel et al. | 271/289 |
| 5,536,000 | A * | 7/1996 | Kelly | 271/189 |
| 5,709,382 | A * | 1/1998 | Shima | 271/209 |
| 5,743,518 | A * | 4/1998 | Takashimizu et al. | 271/4.1 |
| 5,897,113 | A * | 4/1999 | Kondo et al. | 271/213 |
| 6,053,493 | A * | 4/2000 | Yokoyama et al. | 271/171 |
| 6,409,166 | B1 * | 6/2002 | Kashimura | 271/213 |
| 6,428,000 | B1 * | 8/2002 | Hara et al. | 271/223 |

(Continued)

FOREIGN PATENT DOCUMENTS

| | | |
|---|---|---|
| JP | 3-61264 | 3/1991 |

(Continued)

OTHER PUBLICATIONS

Office Action issued in Korean Patent Application No. 2005-26859 on Apr. 25, 2006.

*Primary Examiner*—Patrick H Mackey
*Assistant Examiner*—Howard Sanders
(74) *Attorney, Agent, or Firm*—Stein McEwen, LLP

(57) ABSTRACT

An image forming apparatus has an image forming part forming an image on paper, and a housing accommodating the image forming part and having a paper stack part stacking paper discharged from the image forming part, and the image forming apparatus includes an accommodating part formed in an edge of the paper stack part and extending in a paper discharge direction; a base plate mounted in the accommodating part to be slidable in the paper discharge direction and a reverse direction opposite to the paper discharge direction; and a stopper hinge-coupled to the base plate to be tiltable among a stand up position where the stopper blocks paper discharged from the image forming part, a rear folding position where the stopper is folded onto the base plate and is at least partially accommodated in the paper stack part, and a front folding position where the stopper is folded in the paper discharge direction.

10 Claims, 6 Drawing Sheets

U.S. PATENT DOCUMENTS

| | | | | |
|---|---|---|---|---|
| 7,237,969 | B2 * | 7/2007 | Bartman | 400/646 |
| 7,395,026 | B2 * | 7/2008 | Seo et al. | 399/405 |
| 2002/0017754 | A1 * | 2/2002 | Kang | 271/223 |
| 2008/0308998 | A1 * | 12/2008 | Dobashi et al. | 271/18 |

FOREIGN PATENT DOCUMENTS

| | | | | |
|---|---|---|---|---|
| JP | 08231134 | A | * | 9/1996 |
| JP | 11-334976 | | | 12/1999 |
| JP | 2000-159413 | | | 6/2000 |
| JP | 2001-166545 | | | 6/2001 |
| JP | 2002193527 | A | * | 7/2002 |
| JP | 2003040516 | A | * | 2/2003 |
| JP | 2003095512 | A | * | 4/2003 |
| JP | 2003345093 | A | * | 12/2003 |
| KR | 1991-18040 | | | 11/1991 |
| KR | 92-8236 | | | 5/1992 |

* cited by examiner

IMAGE FORMING APPARATUS HAVING STOPPER

CROSS-REFERENCE TO RELATED APPLICATIONS

This application claims the benefit of Korean Patent Application No. 2005-26859 filed on Mar. 31, 2005, in the Korean Intellectual Property Office, the disclosure of which is incorporated herein by reference.

BACKGROUND OF THE INVENTION

1. Field of the Invention

An aspect of the present invention relates to an image forming apparatus, and more particularly to an image forming apparatus having a stopper on a paper stack part on which discharged printing paper is stacked.

2. Description of the Related Art

A conventional image forming apparatus has a problem that paper on which an image has been formed is disorderly stacked when it is discharged. An image forming apparatus disclosed in Japanese Patent First Publication No. 11-334976 is proposed to solve this problem. Referring to FIG. 1, the image forming apparatus comprises an image reader 10 provided in an upper part of the apparatus, an image forming part 20 provided in a lower part of the apparatus, a paper stack part 31 formed between the image reader 10 and the image forming part 20, and a stopper 32 projecting from the paper stack part 31. Paper on which an image has been formed in the image forming part 20 is stacked on the paper stack part 31 through a fixing part 21 and an outlet 22. In a case where the paper is discharged at an excessive speed in a paper discharge direction, the paper is stopped by the stopper 32 so that the paper is orderly stacked on the paper stack part 31. Referring to FIG. 2, the stopper 32 is accommodated in an accommodating part (not shown) of the paper stack part 31 where it is hinge-coupled to a case 33 slidably mounted in the accommodating part, and is driven by a solenoid 34 and a spring 35 to rotate in a forward/backward direction.

However, in the conventional image forming apparatus, when the paper strikes the stopper 32 as a result of being discharged at an excessive speed, it is not stacked at a predetermined position on the paper stack part 31, and it may be scattered from place to place.

Further, the paper can be removed in a state where the stopper 32 is inserted in the case 33, which makes removing the paper difficult.

SUMMARY OF THE INVENTION

Accordingly, it is an aspect of the invention to provide an image forming apparatus having an improved structure which enables paper discharged from an image forming part to be orderly stacked at a predetermined position on a paper stack part, and enables the paper stacked on the paper stack part to be easily removed.

In accordance with one aspect of the invention, an image forming apparatus has an image forming part forming an image on paper, and a housing accommodating the image forming part and having a paper stack part stacking paper discharged from the image forming part, and the image forming apparatus includes an accommodating part formed in an edge of the paper stack part and extending in a paper discharge direction; a base plate mounted in the accommodating part to be slidable in the paper discharge direction and a reverse direction opposite to the paper discharge direction;

and a stopper hinge-coupled to the base plate to be tiltable among a stand up position where the stopper blocks paper discharged from the image forming part, a rear folding position where the stopper is folded onto the base plate and is at least partially accommodated in the paper stack part, and a front folding position where the stopper is folded in the paper discharge direction.

The image forming apparatus may further include a tilt preventing unit to prevent tilting of the stopper while the stopper is located at the stand up position.

The tilt preventing unit may include an engaging unit to prevent the stopper from tilting toward the rear folding position while the stopper is located at the stand up position; and an elastic pressing unit to press the stopper to return the stopper to the stand up position when the stopper tilts toward the front folding position while the stopper is located at the stand up position.

The engaging unit may include a hinge shaft formed on the base plate; a hinge hole formed in the stopper as an elongated hole in which the hinge shaft is inserted and along which the hinge shaft is movable; a projection part formed on the stopper; and an engaging stepper formed on the base plate to engage the projection part of the stopper when the stopper is located at the stand up position; wherein the projection part is locked and released by the engaging stepper as the hinge shaft moves back and forth along the hinge hole.

The base plate may include an auxiliary holder to prevent the stopper from tilting toward the front folding position while the stopper is located at the stand up position; wherein the stopper is locked and released by the auxiliary holder as the hinge shaft moves back and forth along the hinge hole.

The elastic pressing unit may include a supporting protrusion formed on the stopper; a tilting coil spring having a coil main body inserted onto the supporting protrusion, a first end part of the tilting coil spring being fixed to the stopper, and a second end part of the tilting coil spring being free to tilt integrally with the stopper; and a hook part provided on the base plate to prevent the second end part of the tilting coil spring from tilting toward the front folding position when the stopper is tilted toward the front folding position while the stopper is located at the stand up position.

The base plate may include a plurality of supporting frames supporting the stopper while the stopper is located at the rear folding position.

The base plate may further include a reinforcing frame formed across the supporting frames.

The stopper may include a plurality of guide parts cooperating with the supporting frames to prevent the stopper from moving in a hinge shaft direction.

The front folding position of the stopper may be horizontal with the rear folding position of the stopper.

The stand up position of the stopper may be vertical with respect to a surface of the paper stack part in which the stopper is installed.

In accordance with another aspect of the invention, an image forming apparatus includes an image forming part that forms an image on paper and then discharges the paper in a paper discharge direction; a paper stack part on which the paper discharged from the image forming part is stacked; and a stopper mounted on the paper stack part to be positionable in a stand up position where the stopper stops the paper discharged from the image forming part from going past the stopper and is elastically biased against tilting away from the stand up position in the paper discharge direction.

In accordance with another aspect of the invention, an image forming apparatus includes an image forming part that forms an image on paper and then discharges the paper in a paper discharge direction; a paper stack part on which the paper discharged from the image forming part is stacked; and a stopper mounted on the paper stack part to be tiltable in the paper discharge direction away from a stand up position where the stopper stops the paper discharged from the image forming part from going past the stopper, and to be slidable in the paper discharge direction and a reverse direction opposite to the paper discharge direction.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
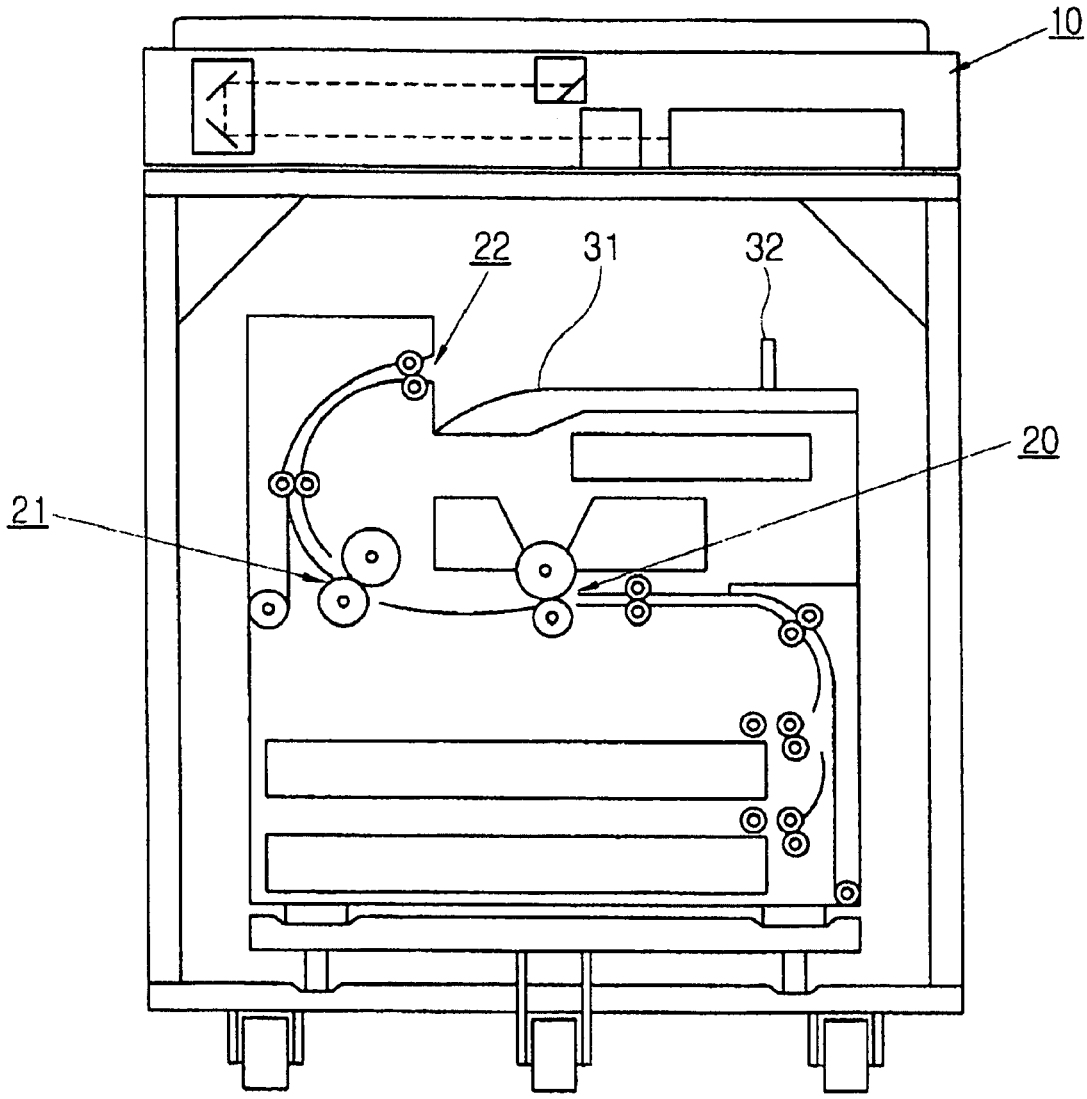
FIG. 1 is a front view of a conventional image forming apparatus.
Figure 2:
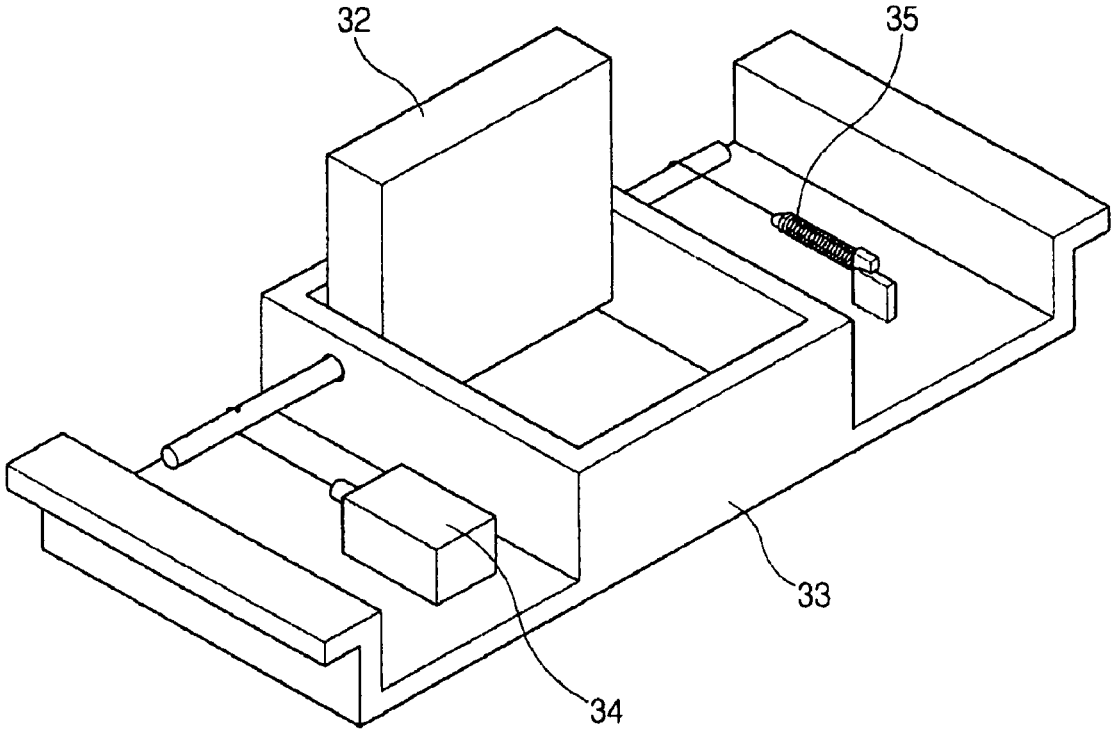
FIG. 2 is an enlarged partial perspective view showing an installation of a stopper shown in FIG. 1.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 3:
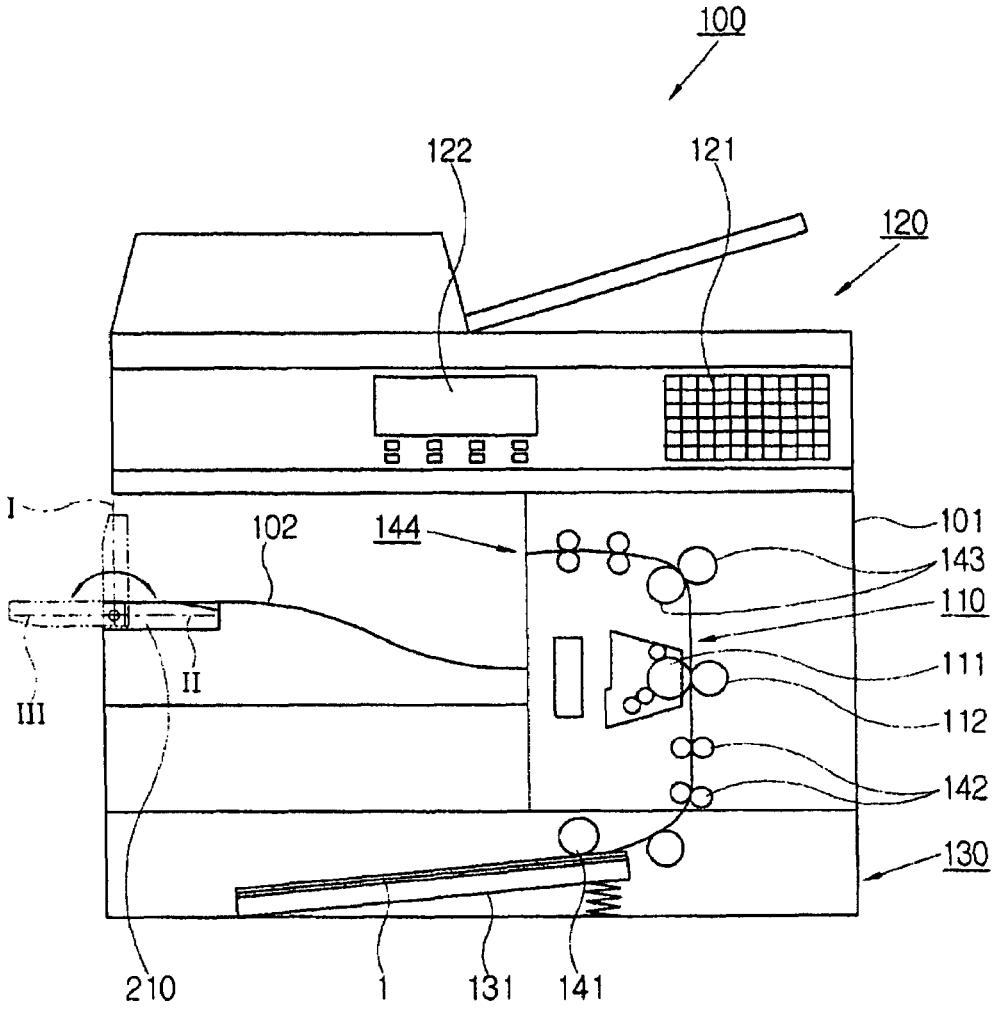
FIG. 3 is a front view of an image forming apparatus according to an embodiment of the present invention.

FIG. 3 is a front view of an image forming apparatus according to an embodiment of the present invention. Referring to FIG. 3, the image forming apparatus is a laser multi-function printer 100. The laser multi-function printer 100 comprises an image forming part 110 forming an image on paper, an image reader 120 provided at an upper part of the image forming part 110, a feeder 130 provided at a lower part of the image forming part 110, and a housing 101 accommodating these elements. The image reader 120 is provided with an image sensor (not shown) which is used to read an image on a paper provided to the image reader 120. A lower side of the image reader 120 is provided with an operation panel 121 and a display part 122.

Printing of an image on paper is accomplished as follows: Paper 1 stacked on a knock-up plate 131 of the feeder 130 is supplied into the image forming part 110 by a pick up roller 141 and carry rollers 142. Then, toner which forms an image is transferred onto the paper via an OPC (organic photoconductor) drum 111 and a transfer roller 112. Further, the toner is fixed on the paper by a fixing roller 143 and the paper is discharged through an outlet 144.

The paper discharged from the outlet 144 is stacked on a paper stack part 102 formed in a part of the housing 101. In a case where the paper is discharged to the paper stack part 102 at an excessive speed, the paper may go past the paper stack part 102. Therefore, if a stopper 210 which can be stood up is mounted at an edge of the paper stack part 102 in a paper discharge direction and a user stands up the stopper 210, the paper discharged to the paper stack part 102 at an excessive speed will be blocked from going past the paper stack part 102 by the stopper 210. The paper blocked by the stopper 210 is stacked on the paper stack part 102 in turn. The stopper 210 can tilt among a stand up position (I) where the stopper 210 blocks the paper, a rear folding position (II) where the stopper 210 is accommodated in the paper stack part 102, and a front folding position (III) where the stopper 210 is folded in the paper discharge direction.

Figure 4:
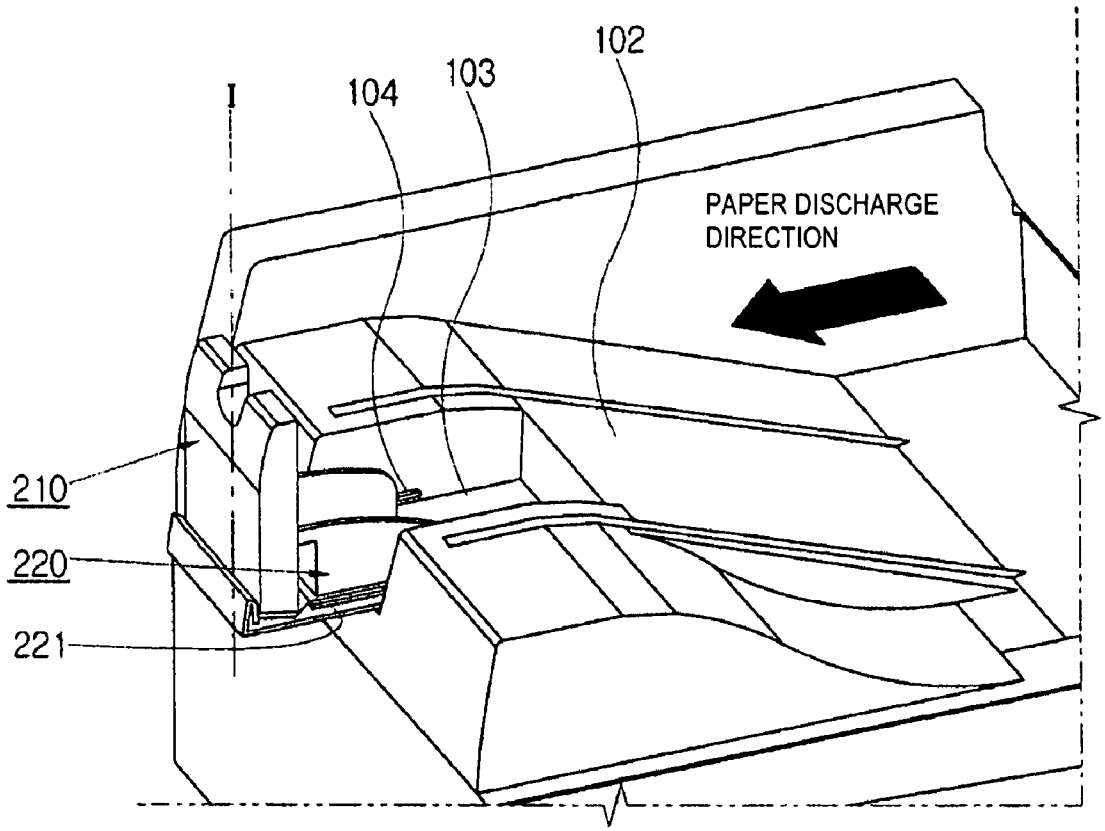
FIGS. 4 through 6 are enlarged partial perspective views looking in different directions showing an installation of a stopper shown in FIG. 3.
Figure 5:
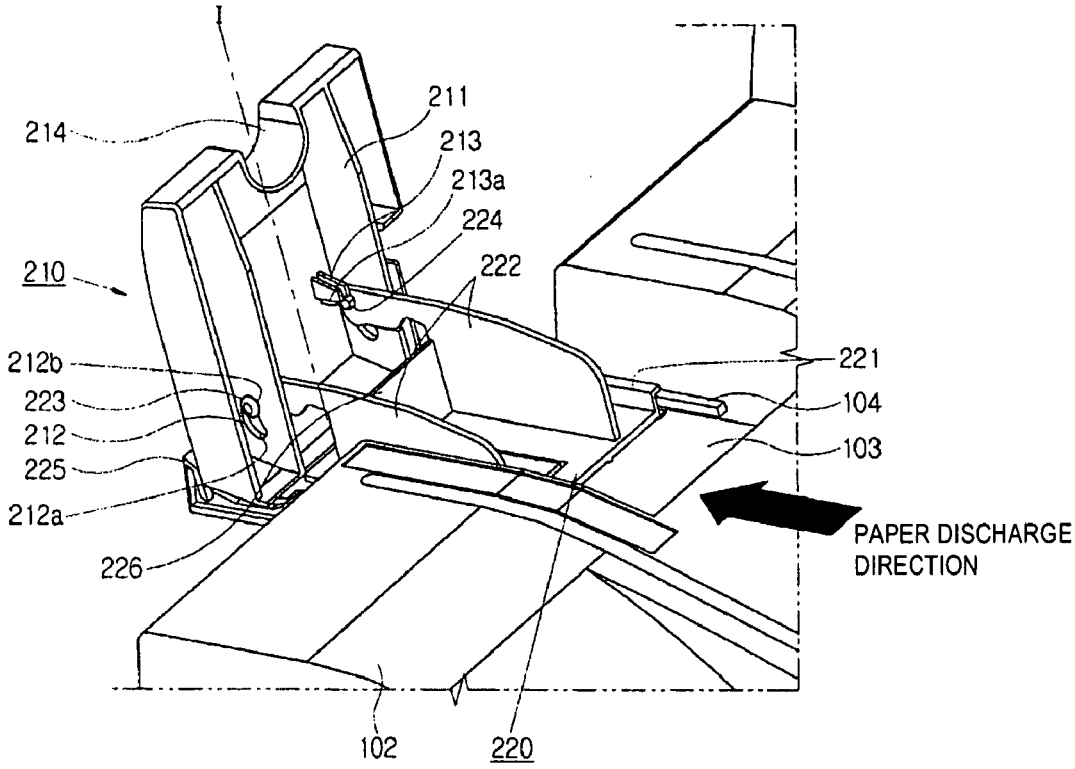
Figure 6:
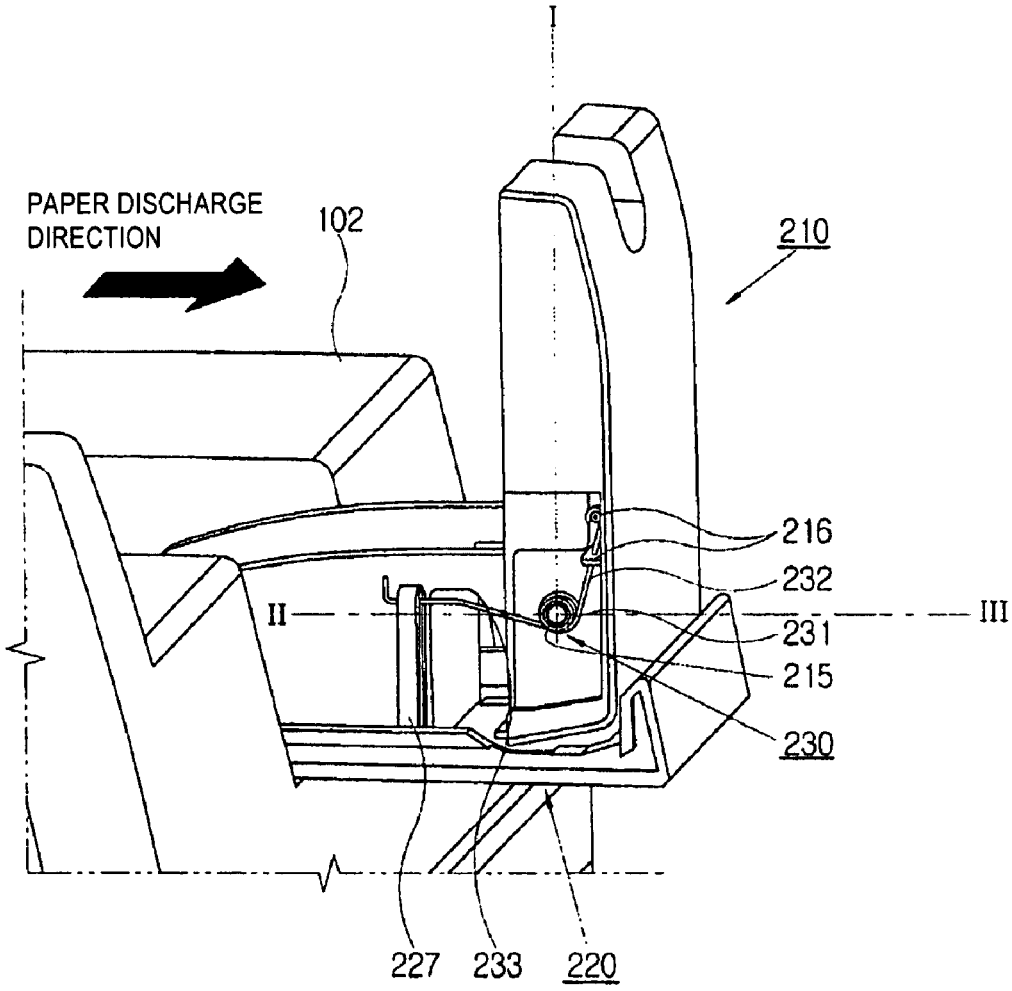

FIGS. 4 through 6 are enlarged partial perspective views looking in different directions showing an installation of the stopper 210. At first, referring to FIG. 4, an accommodating part 103 is formed in a middle part of the edge of the paper stack part 102 extending in the paper discharge direction. A sliding way 104 extends along a lower part of both sidewalls of the accommodating part 103 in the paper discharge direction. A base plate 220 is accommodated in the accommodating part 103. A sliding guide 221 is formed on both sides of the base plate 220 and is slidably coupled to the sliding way 104 of the accommodating part 103. Therefore, the base plate 220 can be slidably inserted into and removed from the accommodating part 103 in the paper discharge direction and a reverse direction opposite to the paper discharge direction (refer to FIG. 5).

The stopper 210 is hinge-coupled to the base plate 220. An upper surface of the stopper 210 has the same surface profile as the paper stack part 102 in a case where the stopper 210 is tilted to the rear folding position (II) (refer to FIG. 3) in a state that the base plate 220 is inserted into the accommodating part 103. Referring to FIG. 4, in a case where the stopper 210 is tilted to the stand up position (I), a sliding position of the base plate 220 is adjusted corresponding to a size of paper to be stacked on the paper stack part 102.

FIG. 5 illustrates a hinge coupling structure between the stopper 210 and the base plate 220. A pair of supporting frames 222 project from the base plate 220. The supporting frames 222 support the stopper 210 when it is folded onto the base plate 220 so that an upper surface of the stopper 210 is located at the same height as an upper surface of the paper stack part 102. Hinge shafts 223 are formed in end parts of the supporting frames 222. A pair of guide parts 211 project from inside the stopper 210 to contact outside surfaces of the supporting frames 222 of the base plate 220. End parts of the guide parts 211 have formed therein respective hinge holes 212 into which the hinge shafts 223 of the supporting frames 222 are inserted. The hinge holes 212 are formed as elongated holes having a circular arc shape.

Projection parts 213 project from inside the stopper 210, and engaging steppers 224 corresponding to the projection parts 213 project from the supporting frames 222 of the base plate 220. The projection parts 213, the engaging steppers 224, and the hinge holes 212 function as an engaging unit which selectively prevents the stopper 210 in the stand up position (I) from tilting to the base plate 220 and enables the stopper 210 in the stand up position (I) to tilt to the base plate 220.

The operation of the image forming apparatus with this configuration will now be described. At first, in a case where the stopper 210 is folded onto the base plate 220, the stopper 210 is coupled with the hinge shafts 223 of the supporting frames 222 via first shaft parts 212*a* of the hinge holes 212. At this moment, the projection parts 213 are located to the rear of the engaging steppers 224, that is, in a reverse direction opposite to the paper discharge direction. When the stopper 210 tilts to the stand up position (I), lower parts 213*a* of the projection parts 213 rotate around the engaging steppers 224 in the process of engaging the engaging steppers 224. At the same time, the stopper 210 moves down vertically due to the shape of the hinge holes 212, causing the hinge shafts 223 to move to second shaft parts 212*b* of the hinge holes 212. Therefore, when the stopper 210 is in the stand up position (I), the projection parts 213 are engaged with the engaging steppers 224, so that the stopper 210 cannot tilt to the rear folding position (II). Further, an auxiliary holder 225 having a predetermined height is formed in an edge of the base plate 220 to prevent the stopper 210 from tilting to the rear folding position (II).

To tilt the stopper 210 to the rear folding position (II), first the stopper 210 is lifted up, causing the hinge shafts 223 to move to the first shaft parts 212*a* of the hinge holes 212 and causing the projection parts 213 to disengage from the engaging steppers 224, and then the stopper 210 is tilted about the hinge shafts 223 to the rear folding position (II). Therefore, the height of the auxiliary holder 225 should be such that the stopper 210 can tilt when the hinge shafts 223 are located at the first shaft parts 212*a*.

Movement of the guide parts 211 of the stopper 210 is blocked by the supporting frames 222 in a direction transverse to the paper discharge direction so that the stopper 210 cannot move in the transverse direction.

A reinforcing frame 226 is formed between the pair of the supporting frames 222 to reinforce the supporting frames 222.

A hand gripping part 214 is formed in an end part of the stopper 210 for use in tilting the stopper 210.

Referring to FIG. 6, a supporting protrusion 215 projects from a side of the stopper 210, and a coil main body 231 of a tilting coil spring 230 is inserted onto the supporting protrusion 215. A first end part 232 of the tilting coil spring 230 is fixed to the stopper 210 by a fixing unit 216, and a second end part 233 of the tilting coil spring 230 is a free end part that tilts integrally with the stopper 210. A hook part 227 is formed on the base plate 220 to surround the second end part 233 of the tilting coil spring 230. The hook part 227 does not contact the second end part 233 of the tilting coil spring 230 when the stopper 210 tilts from the rear folding position (II) to the stand up position (I). However, the hook part 227 prevents the second end part 233 of the tilting coil spring 230 from tilting with the stopper 210 when the stopper 210 tilts from the stand up position (I) to the front folding position (III). The supporting protrusion 215, the tilting coil spring 230, and the hook part 227 function as an elastic pressing unit to press the stopper 210 to return the stopper 210 to the stand up position (I) in a case where the stopper 210 tilts from the stand up position (I) to the front folding position (III).

That is, with the elastic pressing unit of the above configuration, in a case where the stopper 210 tilts between the rear folding position (II) and the stand up position (I), the second end part 233 of the tilting coil spring 230 freely tilts through a space formed inside the hook part 227 so that it does not have any effect on the tilting of the stopper 210. However, the second end part 233 of the tilting coil spring 230 contacts an edge of the hook part 227 when the stopper 210 is located in the stand up position (I), such that the second end part 233 of the tilting coil spring 230 is hooked by the edge of the hook part 227 and is prevented from tilting any further when the stopper 210 starts to tilt to the front folding position (III). Therefore, an elastic restoring force is generated by the tilting coil spring 230 in proportion to a tilting amount of the stopper 210 tilting from the stand up position (I) to the front folding position (III). The elastic restoring force is applied to the stopper 210 via the first end part 232 of the tilting coil spring 230, and makes the stopper 210 return to the stand up position (I).

With the elastic pressing unit of this configuration, in a case where the paper which is discharged from the outlet (144 of FIG. 3) strikes the stopper 210, the stopper 210 tilts in the paper discharge direction, causing an elastic restoring force to be generated by the tilting coil spring 230. This elastic restoring force makes the stopper 210 return to the stand up position (I), thereby pushing the paper in a reverse direction opposite to the paper discharge direction and causing the paper to be stacked at a predetermined position on the paper stack part 102.

When stacking of the paper is completed and the paper is then removed by pulling it out in the paper discharge direction, the stopper 210 tilts toward the front folding position (III) as a result of catching on the paper which is being removed. Therefore, removal of the paper is easy.

As described above, the stopper 210 which is capable of tilting toward the front folding position (III) may be preferably applied to the laser multi-function printer 100 of FIG. 3, because removal of the paper is blocked by the housing 102 accommodating the image forming part 110 in a direction transverse to the paper discharge direction.

Further, as shown by tests with the embodiment of the prevent invention shown in FIG. 3, a case where the front folding position (III) is horizontal (that is, at an angle of 180°) with respect to the rear folding position (II), and the stand up position (I) is vertical (that is, at an angle of 90°) with respect to a surface of the paper stack part 102 in which the stopper 210 is installed, is the most effective for orderly stacking of the paper and easy removal of the paper. Alternatively, an angle between the front folding position (III) and the rear folding position (II) may be more or less than 180° within a preferable range in which removal of the paper is easy. Further, the stand up position (I) of the stopper 210 is not limited to vertical (90°), but may be at various angles within a preferable range in which the paper can be orderly stacked.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An image forming apparatus having an image forming part forming an image on paper, and a housing accommodating the image forming part and having a paper stack part stacking paper discharged from the image forming part, the image forming apparatus comprising:

an accommodating part formed in an edge of the paper stack part and extending in a paper discharge direction;

a base plate mounted in the accommodating part to be slidable in the paper discharge direction and a reverse direction opposite to the paper discharge direction;

a stopper hinge-coupled to the base plate to be tiltable among a stand up position where the stopper blocks paper discharged from the image forming part, a rear folding position where the stopper is folded onto the base plate and is at least partially accommodated in the paper stack part, and a front folding position where the stopper is folded in the paper discharge direction; and a tilt preventing unit to prevent tilting of the stopper while the stopper is located at the stand up position.

2. The image forming apparatus according to claim 1, wherein the tilt preventing unit comprises:

an engaging unit to prevent the stopper from tilting toward the rear folding position while the stopper is located at the stand up position; and an elastic pressing unit to press the stopper to return the stopper to the stand up position when the stopper tilts toward the front folding position while the stopper is located at the stand up position.

3. The image forming apparatus according to claim 2, wherein the engaging unit comprises:

a hinge shaft formed on the base plate;

a hinge hole formed in the stopper as an elongated hole in which the hinge shaft is inserted and along which the hinge shaft is movable;

a projection part formed on the stopper; and an engaging stepper formed on the base plate to engage the projection part of the stopper when the stopper is located at the stand up position; and wherein the projection part is locked and released by the engaging stepper as the hinge shaft moves back and forth along the hinge hole.

4. The image forming apparatus according to claim 3, wherein the base plate comprises an auxiliary holder to prevent the stopper from tilting toward the front folding position while the stopper is located at the stand up position; and wherein the stopper is locked and released by the auxiliary holder as the hinge shaft moves back and forth along the hinge hole.

5. The image forming apparatus according to claim 2, wherein the elastic pressing unit comprises:

a supporting protrusion formed on the stopper;

a tilting coil spring having a coil main body inserted onto the supporting protrusion, a first end part of the tilting coil spring being fixed to the stopper, and a second end part of the tilting coil spring being free to tilt integrally with the stopper; and a hook part provided on the base plate to prevent the second end part of the tilting coil spring from tilting toward the front folding position when the stopper is tilted toward the front folding position while the stopper is located at the stand up position.

6. The image forming apparatus according to claim 1, wherein the base plate comprises a plurality of supporting frames supporting the stopper while the stopper is located at the rear folding position.

7. The image forming apparatus according to claim 6, wherein the base plate further comprises a reinforcing frame formed across the supporting frames.

8. The image forming apparatus according to claim 6, wherein the stopper comprises a plurality of guide parts cooperating with the supporting frames to prevent the stopper from moving in a hinge shaft direction.

9. The image forming apparatus according to claim 1, wherein the front folding position of the stopper is horizontal with the rear folding position of the stopper.

10. The image forming apparatus according to claim 1, wherein the stand up position of the stopper is vertical with respect to a surface of the paper stack part in which the stopper is installed.

* * * * *